US005757113A

United States Patent [19]

Binder et al.

[11] Patent Number: 5,757,113

[45] Date of Patent: May 26, 1998

[54] MEDIUM/HIGH VOLTAGE INCANDESCENT LAMP AND REFLECTOR COMBINATION

[75] Inventors: Ulrich Binder, Munich; Rolf Kiesel, Aalen, both of Germany

[73] Assignee: Patent-Treuhand-Gesellschaft für elektrische Gluehlampen mbH, Munich, Germany

[21] Appl. No.: 727,610

[22] PCT Filed: Apr. 7, 1995

[86] PCT No.: PCT/DE95/00474

§ 371 Date: Oct. 17, 1996

§ 102(e) Date: Oct. 17, 1996

[87] PCT Pub. No.: WO95/28599

PCT Pub. Date: Oct. 26, 1995

[30] Foreign Application Priority Data

Apr. 19, 1994 [DE] Germany ..... 44 13 370.7

[51] Int. Cl.[6] ..... F21V 7/00

[52] U.S. Cl. ..... 313/114; 313/115; 313/113

[58] Field of Search ..... 313/113, 114, 313/111, 110, 115

[56] References Cited

U.S. PATENT DOCUMENTS

| | | | |
|---|---|---|---|
| 4,021,659 | 5/1977 | Wiley . | |
| 4,833,576 | 5/1989 | Mers et al. | 313/113 |
| 4,870,318 | 9/1989 | Csanyi et al. | 313/113 |
| 5,146,134 | 9/1992 | Stadler et al. . | |
| 5,160,199 | 11/1992 | Berti | 313/113 |
| 5,272,408 | 12/1993 | Levin et al. . | |
| 5,367,219 | 11/1994 | Friederichs | 313/113 |

FOREIGN PATENT DOCUMENTS

| | | |
|---|---|---|
| WO-A-92/17733 | 4/1991 | WIPO . |

*Primary Examiner*—Ronald L. Biegel
*Assistant Examiner*—Max H. Noori
*Attorney, Agent, or Firm*—Frishauf, Holtz, Goodman, Langer & Chick, P.C.

[57] ABSTRACT

A reflector incandescent lamp for high-voltage operation has substantially axially parallel radiant body sections and a reflector, whose facets are formed by approximately axially parallel cylindrical segments.

13 Claims, 5 Drawing Sheets

MEDIUM/HIGH VOLTAGE INCANDESCENT LAMP AND REFLECTOR COMBINATION

FIELD OF THE INVENTION

Figure 1:
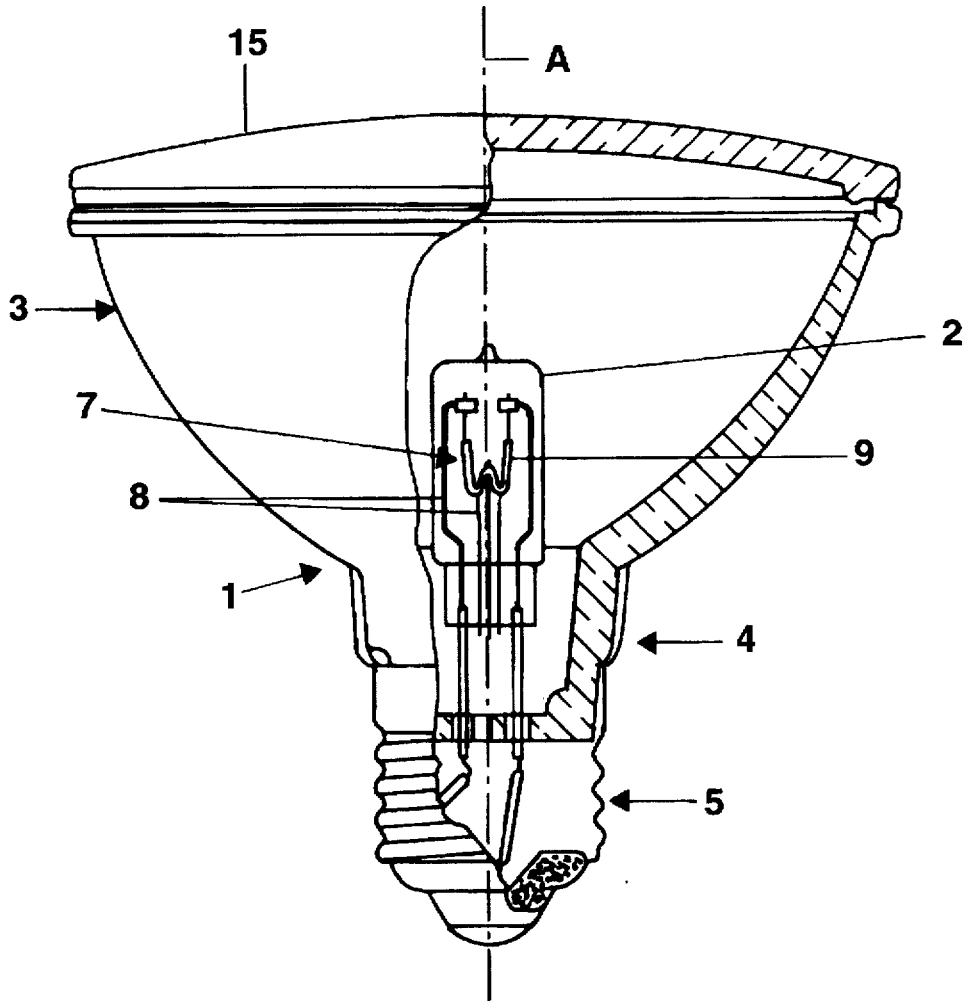

The invention relates to a reflector incandescent lamp combination having an at least substantially axially arranged radiant body.

BACKGROUND

A reflector lamp is described in U.S. Pat. No. 4,021,659, Wiley. The lamp described there has an axial coil and facets which are either flat or curved in convex fashion. The homogeneity of the light distribution in such lamps is not satisfactory for all applications, however. Above all, such a design is only conditionally suitable for medium- and high-voltage lamps (typically, the practical lower limit is 80 V), since then, compared to the low-voltage range, the radiant bodies must be chosen to be very long, and often they are divided into a plurality of sections.

THE INVENTION

The object of the present invention is to improve the homogeneity of the light projected by reflector incandescent lamps which, in particular, are operated at medium or high voltage, that is, above 80 V.

Briefly, the lamp of the lamp-reflector combination has a radiant body which is oriented substantially axially or axially-parallel with respect to the reflector, in which the lamp is also, preferably securely, mounted. The reflector has a reflective surface which is formed substantially of trapezoid-like facets. The majority of the facets are formed as concavely curved cylindrical surfaces with an associated axis of symmetry, each axis of symmetry being located in a plane which includes the reflector axis. The radiant body of the lamp has at least two luminous sections, and the luminous sections are so located in the lamp that, with respect to the reflector, they are approximately axially parallel to the reflector axis, but do not coincide with the reflector axis.

It has been found that the homogeneity of the illumination, especially in lamps with multiple radiant body sections, can be improved considerably if the facets of the reflector comprise concex cylindrical segments. It is essential, however, for the axes of the cylindrical segments to be oriented such that they are located in planes that include the reflector axis. In particular, these axes should be oriented approximately parallel to the reflector axis. "Convex" is to be understood with reference to the optically active side of the reflector.

Conversely, it has been found that cylindrical segments whose axes are transverse to the reflector axis exhibit major nonhomogeneities of illumination.

The particular advantage of the cylindrical segments of the invention is that as a result, not only lamps with an axial radiant body (especially low-voltage lamps) but also lamps whose radiant bodies are composed of a plurality of approximately axially parallel sections, especially high- and medium-voltage lamps (generally understood to mean voltages above 80 V), that provide homogeneous illumination can be furnished. To achieve an homogeneous illumination, the individual sections of the radiant body are inclined by no more than 15° and preferably at most 10° from the reflector axis. Examples are V shapes W shapes or the like, and especially shapes that are varied in mirror symmetry to them, such as U and M shapes.

In particular, through the characteristics of the invention, even very compact reflector lamps can be made. A halogen incandescent lamp is advantageously used for the purpose. In particular, its structural length can be decreased further by dispensing with a quartz beam for the mount that holds the radiant body. The mount parts are retained directly in a pinch seal. Instead of being held by a mount (or in addition to it), the radiant body can also be retained by deformations of the bulb see U.S. Pat. No. 5,146,134, Stadler et al..

DRAWINGS

An exemplary embodiment will be described in further detail below. Shown are

Figure 3:
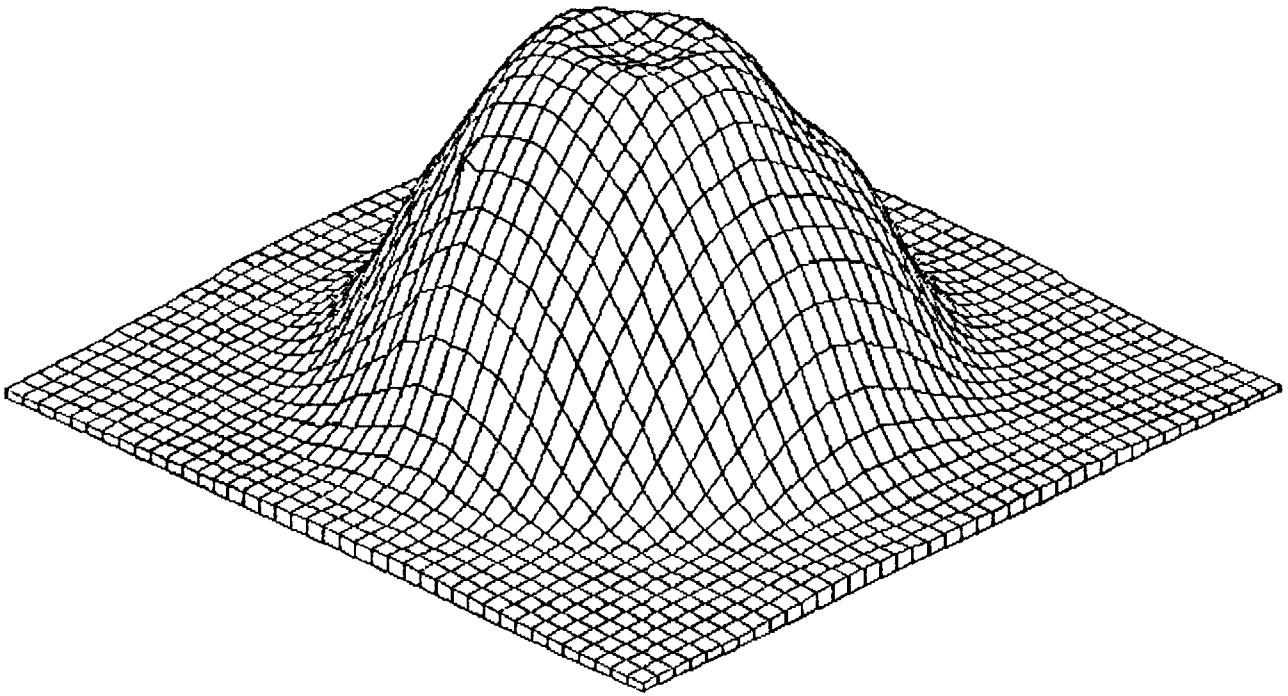
Figure 4:
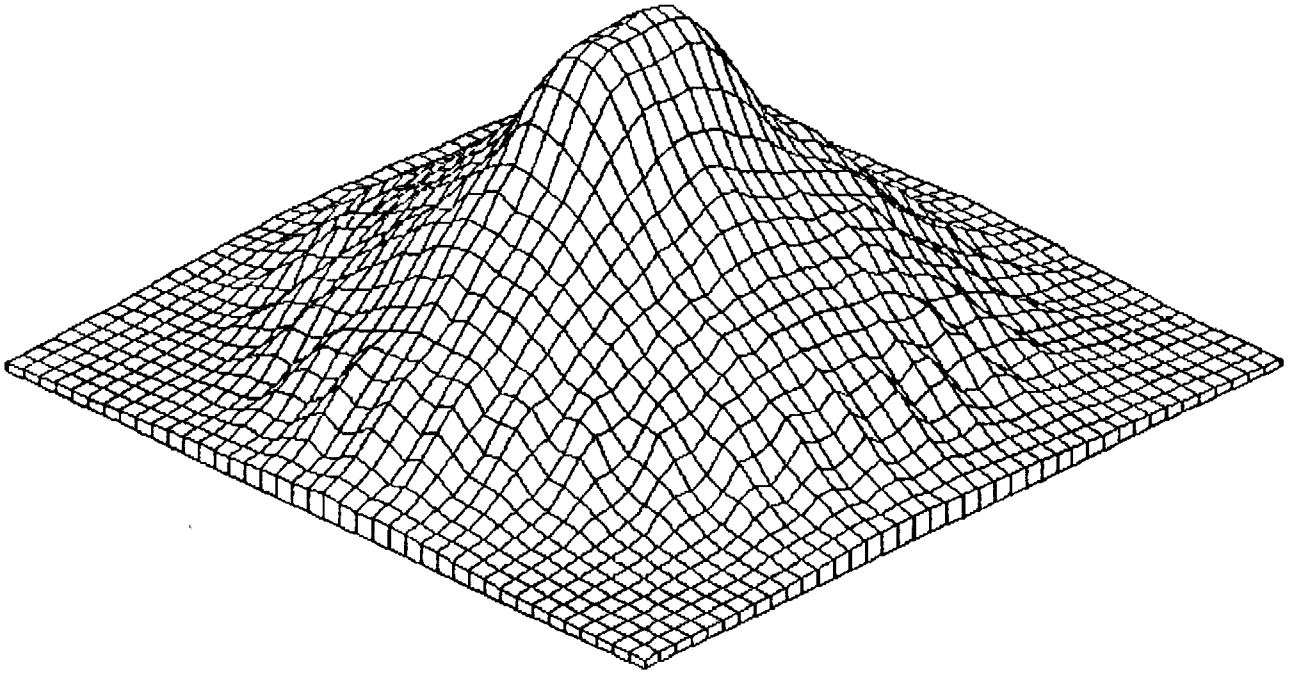
Figure 5:
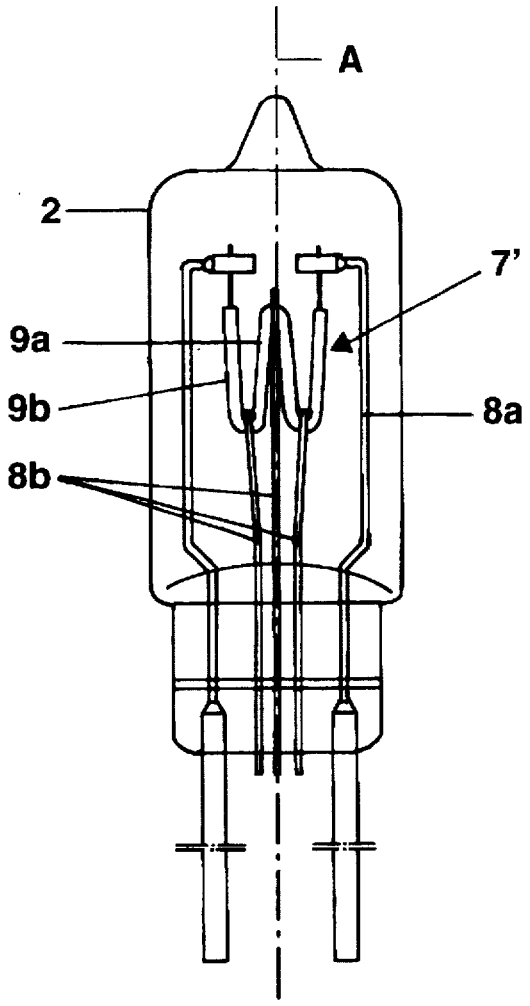

FIG. 1, a reflector incandescent lamp combination with axially parallel cylindrical facets;

FIG. 2, a cross section through the reflector;

FIG. 3, the light distribution of the lamp of FIG. 1;

FIG. 4, the light distribution of a lamp with cylindrical facets lying transversely;

FIG. 5, a further embodiment of a lamp.

Figure 2B:
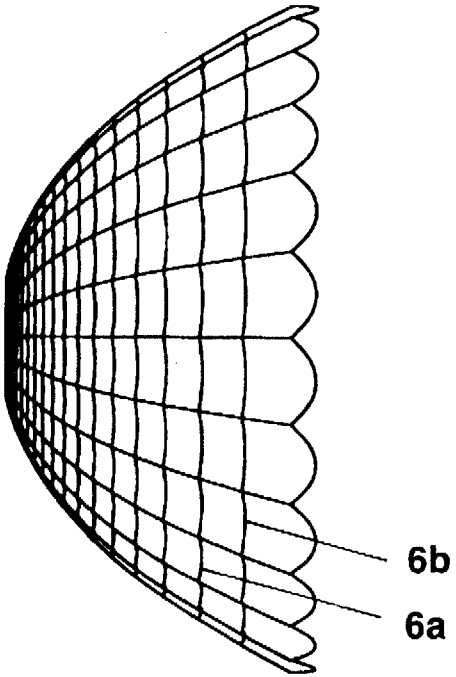
Figure 2A:
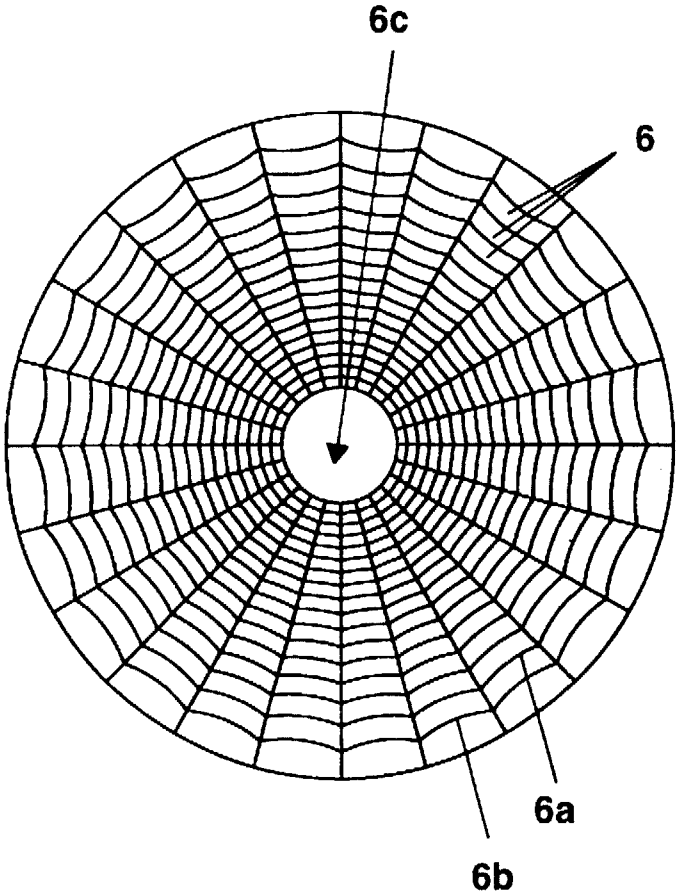

FIG. 1 shows a reflector incandescent lamp 1 for general lighting purposes. It comprises a high-voltage (230 V) halogen incandescent lamp 2 with an output of 50 W, which is secured via two long power leads in the apex of a pressed glass reflector 3, which has a diameter of 63 mm (PAR 20) or 95 mm (PAR 30), for example. The reflector defines a reflector axis A. The reflector has a neck 4, which is secured in a screw-type base 5. As its reflective surface, it has an array of trapezoid-like facets 6 (FIG. 2). The individual facets are portions of cylinders, whose edges abut one another. The arc length of the edge **6*b* of the facet pointing toward the reflector opening is greater than that of the edge 6*a* pointing toward the apex 6*c*. Overall, the reflector is formed of 17 rows of facets, and the first and last rows have facets of a different structure. The arrangement of the cylindrical facets can be seen better in the plan view and side view of FIGS. 2*a* and 2*b***, respectively, which show only the reflector.

The halogen incandescent lamp 2 generally located coaxially with axis A in the reflector 3, has a radiant body 7 bent into a W, which is retained by five mount wires 8, which are anchored in the pinch. The luminous sections 9 of the radiant body are oriented approximately parallel to the reflector axis A, but not along the axis A. The luminous sections 9 are inclined by a maximum of 10° from the reflector axis A. The reflector opening is covered by a lens 15.

FIG. 3 shows the light distribution of a lamp with cylindrical facets whose axis of symmetry includes the reflector axis. The homogeneity is substantially better than in a similar lamp whose cylindrical facets (FIG. 4) are located transversely to the reflector axis.

FIG. 5 shows still another example for an advantageously usable lamp 2, having a W-shaped radiant body 7' with four luminous sections 9. The inner sections **9*a* are approximately equal in length to the outer sections which do not coincide with axis A, 9*b***. None of these sections is inclined by more than 15° from the reflector axis A.

The facets according to the invention are each adapted ot the radiant body. In principle, the directrix of the cylindrical facet surface can be chosen as circular, but also as elliptical, parabolic or hyperbolic. The term "directrix" is here used in the engineering sense, that is, the curve along which a line, extending therefrom, moves to generate a surface. When this line, as it moves, remains parallel to itself, it will generate a cylindrical surface; if it is inclined, a conical surface (see: Adler, "The Theory of Engineering Drawing", Van Nostrand, Copyright 1912, 1915). The generatrix of the facet can be located parallel to the axis of symmetry of the facet, or it may be inclined to it in the manner of a truncated cone.

The axis of symmetry mentioned here, on being projected onto each cylindrical surface, divides that surface into two mirror-symmetrical halves.

In the case of a circular generatrix, this axis is defined by the center point of the circle; in an elliptical generatrix, it is defined by the middle point between the two foci, for instance, and so forth.

Typically, the jacket face of the cylindrical facet is oriented parallel to the axis of symmetry of the facet. This does not, however, preclude the possibility that the jacket face may, in cone-line manner, be inclined from the axis of symmetry.

We claim:

1. A reflector-incandescent lamp combination, comprising a reflector (3) defining a reflector axis (A) and a lamp (2), said lamp having a radiant body (7) oriented in a plane substantially axially or axially parallel to the reflector, said reflector (3) having a reflective surface which is formed substantially of trapezoid-like facets (6), wherein the majority of the facets comprise convexly curved cylindrical surfaces with an associated axis of symmetry, each axis of symmetry being located in a plane that includes the reflector axis (A), wherein the radiant body (7) has at least two luminous sections (9), and wherein said at least two of said luminous sections are located in the lamp (2) approximately axially parallel to, but not coincident with, said reflector axis (A).

2. The reflector-incandescent lamp combination of claim 1, wherein the axes of symmetry of the cylindrical surfaces are oriented approximately parallel to the reflector axis (A).

3. The reflector-incandescent lamp combination of claim 1, wherein the lamp is rated for operation with a voltage of at least 80 V.

4. The reflector-incandescent lamp combination of claim 1, wherein the luminous sections (9) comprise a filament coil, and wherein the coil has two approximately axially parallel sections.

5. The reflector-incandescent lamp combination of claim 4, wherein the coil forms a "W" or a "V" when viewed in the direction of an apex of the reflector is at the top.

6. The reflector-incandescent lamp combination of claim 1, wherein the luminous sections (9) of the radiant body (7) are inclined by at most 15° from the reflector axis (A).

7. The reflector-incandescent lamp combination of claim 6, wherein the luminous sections (9) of the radiant body (7) are inclined by less than 10° from said reflector axis (A).

8. The reflector-incandescent lamp combination of claim 1, wherein the lamp is a halogen incandescent lamp.

9. The reflector-incandescent lamp combination of claim 8, wherein the lamp (2) terminates in a pinch seal;

and the radiant body (7) is retained in the lamp in said pinch seal, or in a mount that is devoid of quartz beams.

10. The reflector-incandescent lamp combination of claim 1, wherein the generatrix of the cylindrical surface extends parallel to its own axis of symmetry, or is inclined to such an axis in the manner of a truncated cone.

11. The reflector-incandescent lamp combination of claim 1, wherein the directrix of the cylindrical facet surface represents a portion of a conical section circle.

12. The reflector-incandescent lamp combination of claim 11, wherein the directrix of the cylindrical facet surface represents a portion of a circle, an ellipse, a parabola or a hyperbola.

13. The reflector-incandescent lamp combination of claim 11, wherein each cylindrical surface of the facets is bounded in trapezoid-like manner by four edges;

and wherein two edges are defined by directrices (6*a*, 6*b*) and two further edges are defined as straight lines connecting the ends of said directrices.

* * * * *